United States Patent [19]

Adams et al.

[11] 4,178,652

[45] Dec. 18, 1979

[54] APPARATUS FOR CLEANING ROLLER SURFACES

[75] Inventors: Leo Adams, River Edge; Edward Kooi, Jersey City, both of N.J.

[73] Assignee: Arvey Corporation, Chicago, Ill.

[21] Appl. No.: 899,516

[22] Filed: Apr. 24, 1978

[51] Int. Cl.[2] ..... B08B 3/00; B08B 7/00; A47L 5/38

[52] U.S. Cl. ..... 15/302; 134/140; 134/144; 134/33; 134/37

[58] Field of Search ..... 134/33, 37, 42, 140, 134/144, 145, 153, 172, 148; 101/423, 424, 425; 15/301, 303, 306 R, 312 R, 302

[56] References Cited

U.S. PATENT DOCUMENTS

| | | | |
|---|---|---|---|
| 3,004,276 | 10/1961 | Hoffman | 15/306 R |
| 3,052,245 | 9/1962 | Nagle | 134/153 |
| 3,060,064 | 10/1962 | Zingg | 134/144 |
| 3,873,364 | 3/1975 | Smith | 134/144 |
| 3,999,239 | 12/1976 | Misuna | 101/425 |

FOREIGN PATENT DOCUMENTS

| | | | |
|---|---|---|---|
| 493468 | 6/1953 | Canada | 134/144 |
| 696636 | 10/1965 | Italy | 134/140 |

*Primary Examiner*—Joseph Scovronek
*Assistant Examiner*—Chris P. Konkol
*Attorney, Agent, or Firm*—Dressler, Goldsmith, Clement, Gordon & Shore, Ltd.

[57] ABSTRACT

A method and apparatus for automatically cleaning the surface of a roller, such as a laminating roller, is disclosed herein. The method consists of rotating the roller at a predetermined fixed speed about its axis and simultaneously moving a nozzle which produces a small stream of steam along the axis of the roller at a fixed speed so that the stream of steam impinges the entire surface of the roller. Tne apparatus consists of a support for rotatably supporting a roller and supporting a nozzle for reciprocation with respect to the axis of the roller with either common or separate drive means for rotating the roller and reciprocating the nozzle.

6 Claims, 3 Drawing Figures

APPARATUS FOR CLEANING ROLLER SURFACES

BACKGROUND OF THE INVENTION

The use of large rollers for applying adhesives, coatings and inks to various surfaces or substrates has been a common practice for many years. The rollers that are used for this purpose must be cleaned periodically to remove buildup of materials upon the surface of the rollers. In other instances, it may be necessary to clean the rollers so that the machine can be used for applying different adhesives, coatings or inks.

Numerous proposals have been made for cleaning the surfaces of such rollers and, so far as presently known, all of these systems require some type of hot or cold solvents to remove a deposited material from the surface of a roller.

One of the most difficult types of roller to clean is the rotogravure roller because these rollers have small cells that are etched into the surface of the roller itself. So far as presently known, in order to remove all of the materials from the small crevices or cells, it is almost mandatory that the final cleaning be done by hand scrubbing the surface of the roller. This becomes a very tedious task with rollers that have application surfaces that are as large as 8 inches in diameter and almost 7 feet in length.

While automated systems have been proposed, many rollers of this type are still cleaned by emersion in a solvent bath for an extended period of time and subsequent hand scrubbing of the surface of the roller.

SUMMARY OF THE INVENTION

According to the present invention, a simple method and apparatus for automatically cleaning the surface of a applicator roller which does not require the use of any solvents is disclosed herein.

The method consists of rotating the roller at a predetermined speed about its own axis and simultaneously moving a small narrow stream of high-pressure steam axially of the roller adjacent the peripheral surface thereof so that the steam impinges on all portions of the peripheral surface of the roller.

The apparatus consists of a support including a housing which encloses the surface area of the roller to be cleaned, with end portions of the roller extending through openings in opposite ends of the housing. A pair of circumferentially spaced freely rotatable support rollers are supported on the housing adjacent each of the openings to rotatably support the roller about a fixed axis and the roller is driven by a variable speed power source.

The support also includes guide rods for guiding a nozzle support member along a fixed path adjacent the peripheral surface of the roller and the guide member is moved through a drive means in the form of a rotatable screw which may be driven by the source which rotates the roller or by a separate source.

The system is designed so that readily available inexpensive high-pressure steam, on the order of 140 psi, can be used to clean the roller and the system requires minimum attention from an operator.

DETAILED DESCRIPTION

Figure 1:
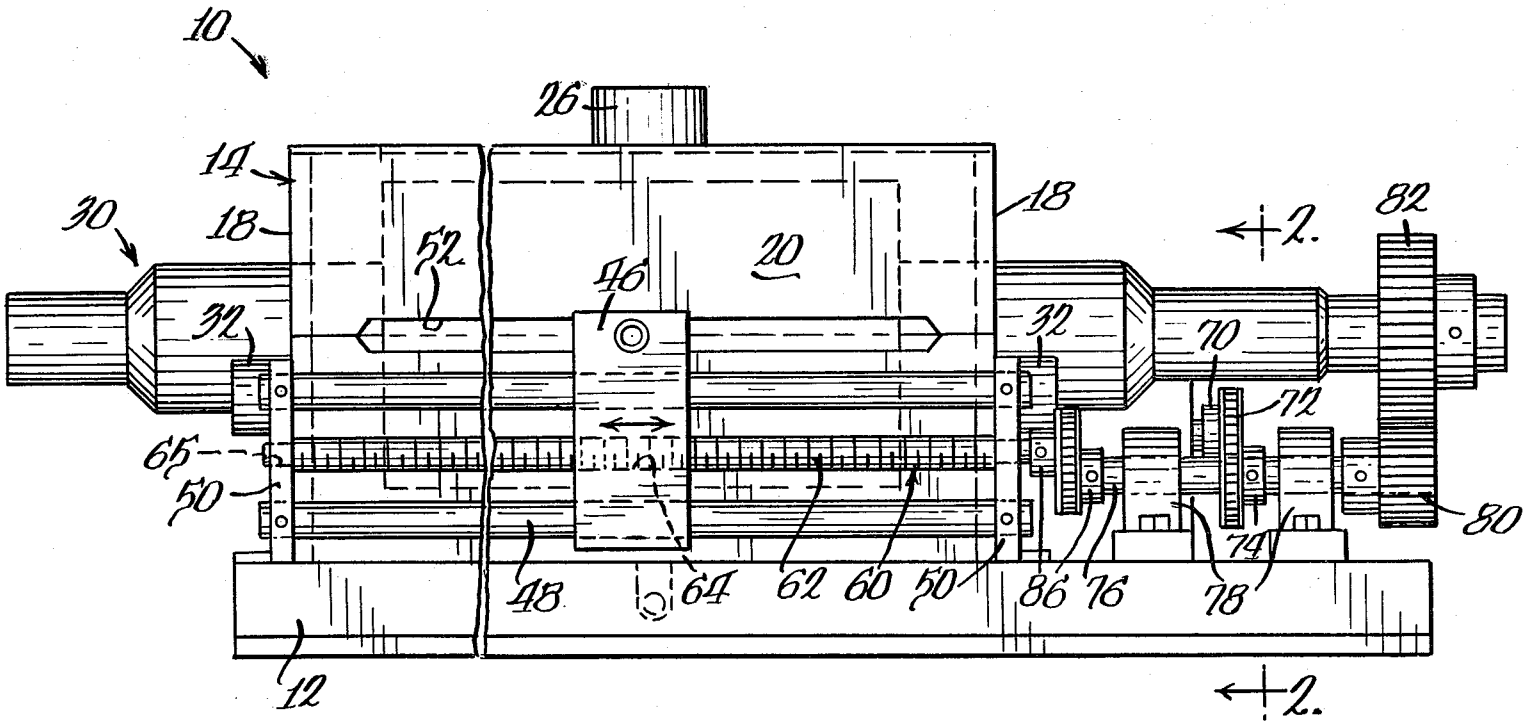
FIG. 1 discloses a side view of the cleaning apparatus of the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

Figure 2:
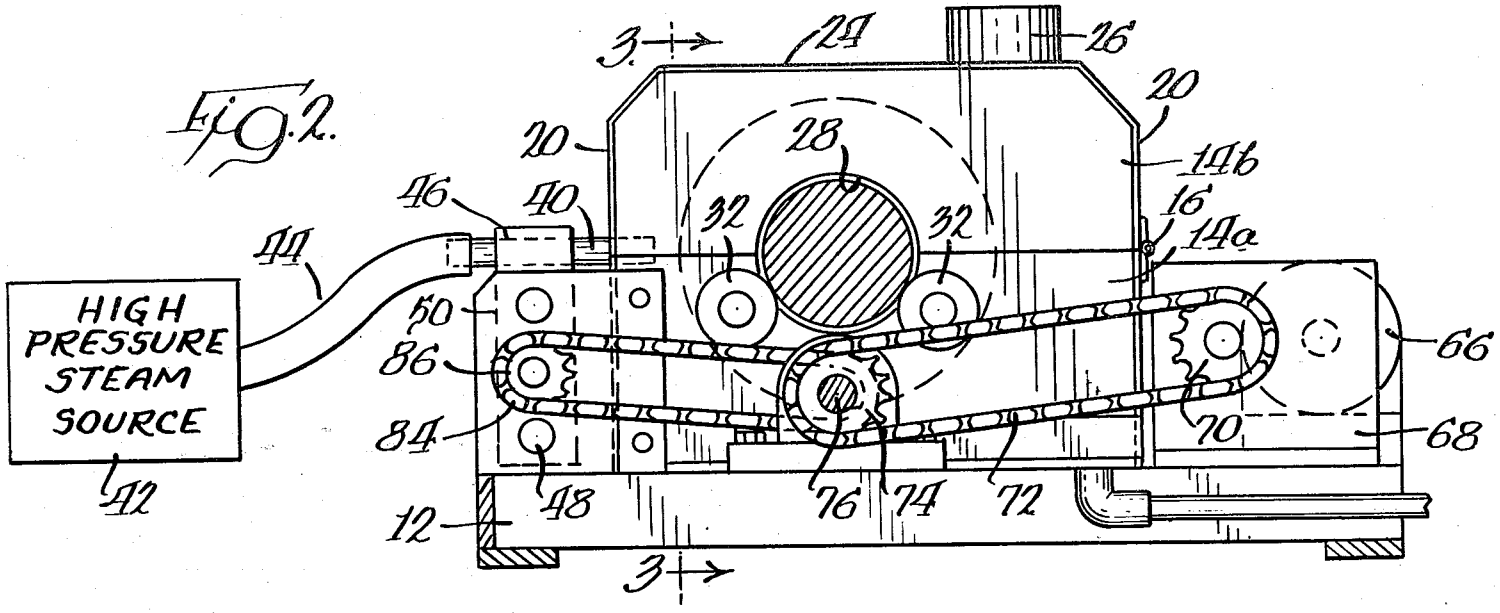
FIG. 2 is a cross-sectional view of the apparatus, as viewed along line 2—2 of FIG. 1.
Figure 3:
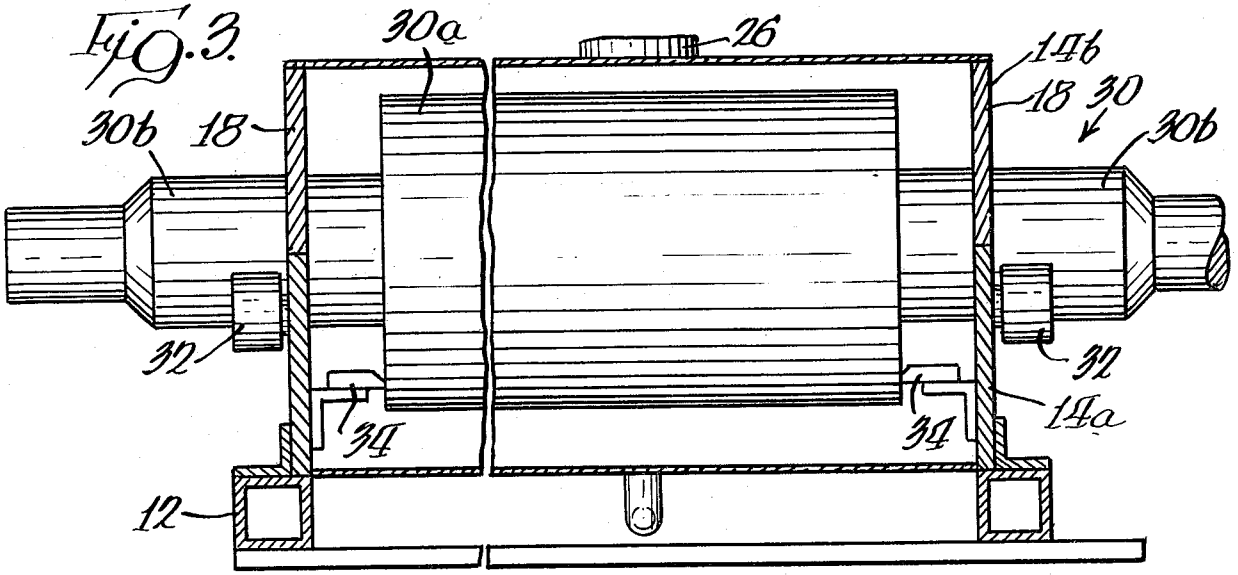
FIG. 3 is a cross-sectional view of the apparatus, as viewed along line 3—3 of FIG. 2.

FIG. 1 of the drawings discloses a roller cleaning apparatus, generally designated by reference numeral 10. Roller cleaning apparatus 10 includes a base or support 12 which has a housing 14 extending from the upper surface thereof. Housing 14 has a lower portion 14*a* (FIG. 2) and an upper portion 14*b* which are joined to each other through hinges 16. Housing 14 has end walls 18, sidewalls 20 and a top wall 22 which has an opening located within a collar 26 so that the internal area of the enclosed housing may be vented to an area such as a smoke stack.

Each end wall 18 has a circular opening 28 and each circular opening has its lower half defined in lower housing 14*a* and its upper half defined in upper housing 14*b*. A roller 30 to be cleaned is inserted into the housing so that the central portion 30*a* to be cleaned is located within the housing while the end or journal portions 30*b* extending through openings 28. The support or base 12 including housing 14 supports roller 30 for rotation about its fixed axis and for this purpose, a pair of circumferentially spaced freely rotatable rollers or journal bearings 32 are supported for rotation about fixed axes on each end wall 18 and are positioned such that their peripheral surfaces are located within the confines of opening 28. Thus, the bearing journals 32 will provide the entire support for roller 30 that is rotated about its axis by drive means that will be described later. Preferably, housing 14 also has guide members 34 extending inwardly from end walls 18 and guide members 34 prevent axial movement of roller 30 during rotation thereof.

The roller cleaning apparatus 10 also includes a nozzle 40 connected to a source of pressurized steam 42 through a conduit 44 for directing a small narrow stream of high pressure steam towards the peripheral surface of central portion 30*a* of roller 30. Nozzle 40 is connected to a nozzle support member 46 which in turn is guided for movement along a path that extends parallel to the axis of roller 30 through a pair of guide rods 48 that are supported at opposite ends on upright members 50 that extend above base 12. Nozzle 40 is supported on nozzle support member 46 so that the free end portion thereof extends through a slot 52 defined in housing 14. Nozzle support member 46 is thus guided for movement along a fixed path that extends parallel to the axis of roller 30 and is moved through drive means 60 that will now be described. In the illustrated embodiment, the drive means 60 consists of a rotatable screw 62 that extends through a threaded opening 64 in support member 46 with opposite ends of rotatable screw 62 journaled for rotation in openings 65 defined in uprights 50.

In the illustrated embodiment, the drive means for rotating screw 62 and roller 30 includes a common power source or motor 66 that has its output shaft connected to a gear reduction unit 68 which has an output sprocket 70 connected to the output shaft thereof. Sprocket 70 is connected through chain means 72 and a sprocket 74 to a driven shaft 76. Driven shaft 76 is supported on base 12 by a pair of bearing journals 78 and has a gear 80 fixed to one end thereof which is a mesh with a gear 82 that is fixed to one end portion 30*b* of roller 30.

In the illustrated embodiment, drive shaft 76 is also connected to rotatable screw 62 through a drive chain 84 and a further pair of drive sprockets 86, one of which is connected to shaft 76 and the other which is connected to rotatable screw 62.

From the above description, it is believed that the operation of the apparatus for cleaning the peripheral surface of a roller 30 will be readily understood but will be briefly summarized at this point. The roller 30 is rotated about its own axis by energizing drive motor 66 which is preferably a reversible variable speed motor. The various sprockets 70, 74, and 86 are selected such that the axial movement of nozzle support member 46 and the rotational movement of roller 30 are such that the entire surface of the roller portion 30*a* to be cleaned will be impinged by the stream of steam as the nozzle is moved from one end of the surface of central portion 30*a* to the opposite end.

Of course, it will be appreciated that the drive means for reciprocating nozzle support member 46 and rotating roller 40 could be separate power sources both of which were adjustable to vary the speed thereof.

In order to place the invention in a proper environment a specific example of a prototype cleaning unit 10 will now briefly be summarized. A first variable speed drive motor (not shown) was connected directly to feed screw 62 and the motor was of the variable speed type so that the speed of rotation of screw 62 was in the range of 0.25 to 3.5 rpm and the diameter of the screw was selected such that the axial travel for this range of rotation was 1/32 to 7/16 inches per minute.

A second motor (not shown) was connected to roller 30 and this motor again was a variable speed type to have a range of 0.25 to 3.5 rpm for the roller. A roller having a diameter of approximately 8 inches in the center portion of 30*a* with an axial length of the center portion of 68 inches was positioned on the support rollers 32 and the rotational speed for roller 30 was set at ¼ rpm while the motor for driving screw 62 was set at such that the travel of nozzle 40 was 2 inches per hour. Thus, in a total of 34 hours, nozzle 40 moved from one end of central portion 30*a* to the opposite end thereof to clean the entire surface of the roller. The pressure of the steam in this test was 140 psi. The roller cleaned in this fashion was acceptable for reuse without any additional manual cleaning. It should be noted that the speed of rotation of the roller and the axial speed of the nozzle support member are to a large measure dependent upon the size of the steam, i.e. the nozzle tip design, and the distance of the tip from the roller.

It will be appreciated that from the above description, the present invention provides an extremely simple mechanism for cleaning the roller which can be automatically operated without the attention of an operator after initial setup. Of course, various modifications come to mind without departing from the spirit of the invention. For example, with a reversible electric motor, the nozzle support member 46 could be reciprocated back and forth across the surface of roller portion 30*a* and the speed of rotation of the roller could be coordinated so that the entire surface could be cleaned more than one time.

What is claimed is:

1. Apparatus for cleaning the surface of a roller comprising a base with a housing extending above said base and having opposite end walls, said housing having a lower portion and an upper portion separable to expose an upper open end of said lower portion and each end wall having means defining an opening with a portion of each opening in each portion, support means on each end wall of said lower portion overlapping said openings for supporting a roller in said housing means for supplying pressurized steam with a nozzle connected thereto to produce a small stream of high pressure steam, said housing having an elongated slot through which said nozzle extends, a support member outside said housing for supporting said nozzle for reciprocal movement along said slot, and drive means for reciprocating said support means and simultaneously rotating said roller within said housing.

2. Apparatus as defined in claim 1, in which said drive means includes a single motor in driving engagement with said roller, and a rotatable screw driven by said motor and extending through a threaded opening in said support means.

3. Apparatus as defined in claim 2, in which said base has a pair of spaced parallel guide rods with said support member guided for reciprocation on said guide rods.

4. Apparatus as defined in claim 1, in which said support means on each end wall includes a pair of freely rotatable rollers circumferentially spaced around each opening.

5. Apparatus as defined in claim 1, further including hinges interconnecting adjacent edges of said portions on one side of the housing.

6. Apparatus as defined in claim 5, in which said elongated slot is defined at the juncture of said housing portions between adjacent edges opposed to said only side.

* * * * *